US007194877B1

(12) United States Patent
Cottrell

(10) Patent No.: US 7,194,877 B1
(45) Date of Patent: Mar. 27, 2007

(54) MULTIPLE ENTRY LOCKING SYSTEM

(76) Inventor: Scott W. Cottrell, 1236 Frogs Leap La., Eugene, OR (US) 97404

( * ) Notice: Subject to any disclaimer, the term of this patent is extended or adjusted under 35 U.S.C. 154(b) by 80 days.

(21) Appl. No.: 10/898,528

(22) Filed: Jul. 22, 2004

Related U.S. Application Data

(60) Provisional application No. 60/491,020, filed on Jul. 29, 2003.

(51) Int. Cl.
*E05B 73/00* (2006.01)

(52) U.S. Cl. ..... 70/14; 70/18; 70/58; 70/DIG. 63; 292/288

(58) Field of Classification Search ..... 70/14, 70/18, 58, DIG. 63, 180, 203, 177, 178, 212, 70/19, 38 A, 50, 53, DIG. 12; 292/288, 292/289, 148, 300, DIG. 29
See application file for complete search history.

(56) References Cited

U.S. PATENT DOCUMENTS 679,645 A * 7/1901 Sweigart ..... 232/53
1,320,771 A * 11/1919 Leahan ..... 70/212
1,364,068 A * 1/1921 Brader ..... 70/212
1,453,882 A * 5/1923 McHugh ..... 70/18
3,190,090 A * 6/1965 Zaidener ..... 70/203
3,656,789 A * 4/1972 Ray ..... 292/304
3,678,717 A * 7/1972 Eaton ..... 70/232
3,703,821 A * 11/1972 Dorey ..... 70/38 R
3,765,197 A * 10/1973 Foote ..... 70/58
3,805,564 A * 4/1974 Velardo ..... 70/18
4,085,599 A * 4/1978 Fischer et al. ..... 70/14
5,141,119 A * 8/1992 Milazzo ..... 212/290
5,570,600 A * 11/1996 Hua ..... 70/247
5,743,116 A * 4/1998 Suster ..... 70/14
6,460,383 B1 * 10/2002 Wadsworth, Jr. ..... 70/177

* cited by examiner

*Primary Examiner*—Lloyd A. Gall
(74) *Attorney, Agent, or Firm*—Robert E. Howard

(57) ABSTRACT

A multiple entry locking system including a U-bolt shackle having slotted legs. Various link members are adapted to be inserted through the slots in the U-bolt shackle legs. Each of the link members have first and second ends, and each of the link members have at least one lock shackle opening passing therethrough adjacent one of the ends thereof. Each of the lock shackle openings is adapted to receive the shackle of a lock. Stop members located adjacent the other of the first and second ends are adapted to prevent withdrawal of the link member through its slot in the direction of the lock shackle opening.

10 Claims, 3 Drawing Sheets

MULTIPLE ENTRY LOCKING SYSTEM

CROSS-REFERENCE TO RELATED APPLICATIONS

This application claims the benefit of U.S. Provisional Application No. 60/491,020, filed Jul. 29, 2003, the entire contents of which are hereby incorporated by reference.

BACKGROUND OF THE INVENTION

The present invention relates to a multiple entry locking system.

Gate latches, hasps, chains, and other such devices, together with their accompanying padlocks, are widely used for securing gates and doors to prevent unauthorized access to equipment and buildings. Many prior art systems do not provide a method to allow multiple users to gain access at a single locking point while maintaining security. Where standard gate hardware is installed, there is no way of using more than one padlock. Locking padlocks together in what is known as a daisy-chain configuration is rather complicated, and often misunderstood and used incorrectly.

SUMMARY OF THE INVENTION

It is an object of the present invention to provide an improved locking system for gates, doors, and any other entry device where it is desirable to employ multiple locks for multiple users.

It is a further object to provide an improved locking system that can be easily retrofitted into pre-existing gates, doors, and other entry devices.

DESCRIPTION OF PREFERRED EMBODIMENTS

The basic element of the multiple entry locking system of the present invention is a slotted U-bolt shackle, which can be either front slotted or side slotted.

Figure 1:
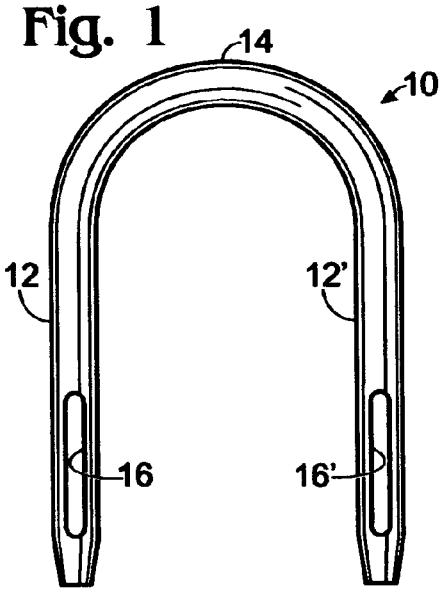
FIG. 1 is a front elevational view of a front slotted U-bolt shackle forming a part of the multiple entry locking system of the present invention.

A front slotted U-bolt shackle 10 is shown in FIG. 1, and includes right and left leg portions 12 and 12' joined by cross member 14. Although cross member 14 is illustrated as being semi-circular in shape, it could be straight or other shapes. The cross-section of leg portions 12 and 12', and cross member 14, is preferably substantially circular. Right slot 16 passes through right leg portion 12 from front to rear at a location adjacent its outer end, and left slot 16' passes through left leg portion 12' from front to rear at a location adjacent its outer end. The outer ends of right and left leg portions 12 and 12' are tapered down to a smaller diameter than the remainder of leg portions 12 and 12'.

Figure 2A:
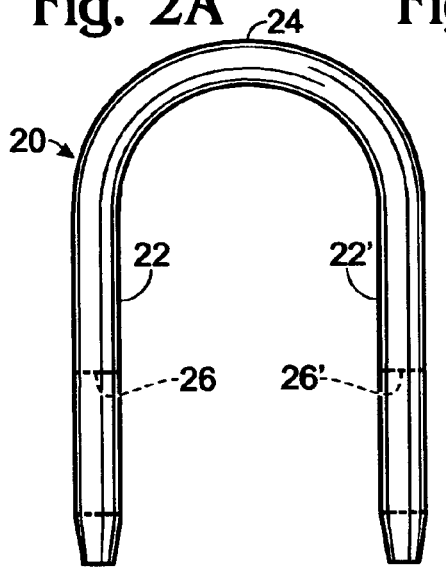
FIG. 2A is a front elevational view of a side slotted U-bolt shackle forming a part of the multiple entry locking system of the present invention.
Figure 2B:
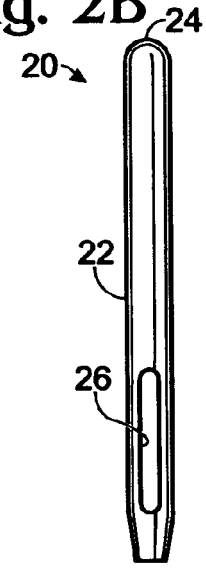
FIG. 2B is a right side elevational view of the side slotted U-bolt shackle.

A side slotted U-bolt shackle 20 is shown in FIGS. 2 and 3, and includes right and left leg portions 22 and 22' joined by cross member 24. The cross-section of leg portions 22 and 22', and cross member 24, is substantially circular. Right slot 26 passes through right leg portion 22 from side to side at a location adjacent its outer end, and left slot 26' passes through left leg portion 22' from side to side at a location adjacent its outer end. The outer ends of right and left leg portions 22 and 22' are tapered down to a smaller diameter than the remainder of leg portions 22 and 22'.

A variety of link members can be employed with front slotted U-bolt shackle 10 to allow two or more users to unlock the multiple entry locking system of the present invention.

Figure 3A:
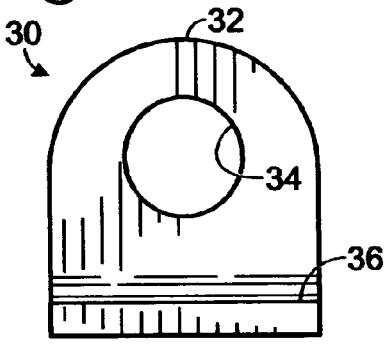
FIG. 3A is a top plan view of a one hole padlock link forming a part of the multiple entry locking system of the present invention.
Figure 3B:
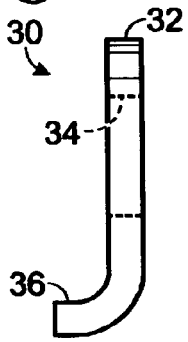
FIG. 3B is a side elevational view of the one hole padlock link.

FIGS. 3A and 3B show a one hole padlock link 30 having a rounded outer end 32, a padlock shackle opening 34 extending therethrough adjacent said outer end 32, and a stop ledge 36 extending from the inner end thereof. In use, one leg 12 or 12' of front slotted U-bolt shackle 10 is inserted through the locking opening of a latch member, or both legs 12 and 12' inserted through the ends of a locking chain. A first one hole link 30 is inserted through slot 16 of U-bolt shackle 10, and a second one hole link 30 is inserted through slot 16' of U-bolt shackle 10. The shackles of first and second padlocks (not shown) are then inserted through the padlock shackle openings 34 of first and second one hole links 30 and locked. The locked closure can be opened by the keyholder of either the first or second padlock by unlocking and removing the padlock and associated one hole link, and removing U-bolt shackle 30 from the latch or chain being secured.

Figure 4:
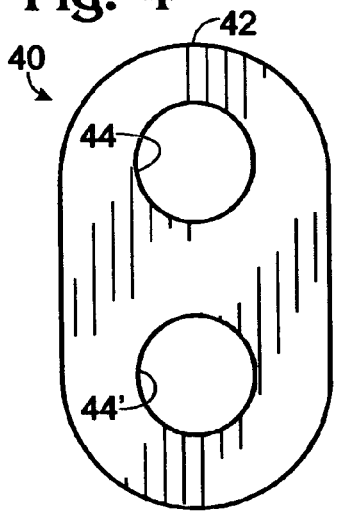
FIG. 4 is a top plan view of a two hole padlock link forming a part of the multiple entry locking system of the present invention.
Figure 5:
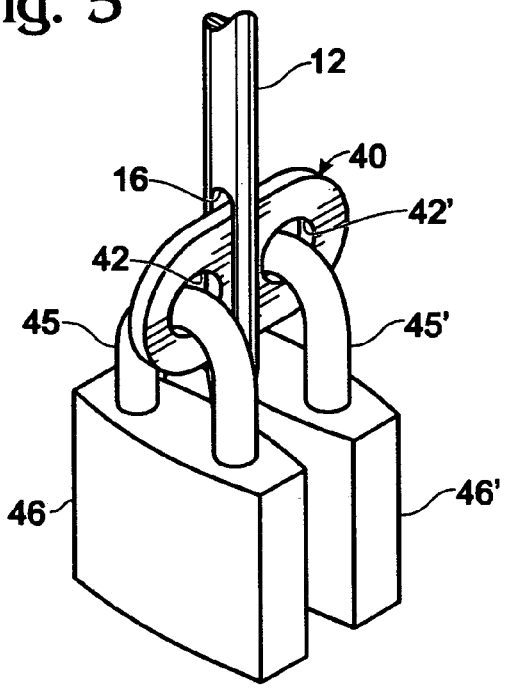
FIG. 5 is a front perspective view of one leg of a front slotted U-bolt shackle shown with the two hole padlock link and two padlocks attached thereto.

FIG. 4 shows a two hole padlock link 40 having rounded ends 42 and 42' and padlock shackle openings 44 and 44' extending therethrough adjacent ends 42 and 42'. FIG. 5 shows leg 12 of front slotted U-bolt shackle 10 with a two hole link 40 inserted into slot 16 and the shackles 45 and 45' of padlocks 46 and 46' attached thereto through padlock shackle openings 42 and 42', respectively. The other leg 12' of U-bolt shackle 30 (not shown) could have a one hole link 30 inserted through its slot 16' and a single padlock attached through padlock shackle opening 34 thereof. With this arrangement, three different users could unlock the system. Alternatively, the other leg 12' of U-bolt shackle 30 could have a second two hole link 40 inserted through its slot 16' with two padlocks attached through padlock shackle openings 44 and 44' of the second two hole link 40 (identical to the configuration shown in FIG. 5). With this arrangement, four different users could unlock the system.

Figure 6A:
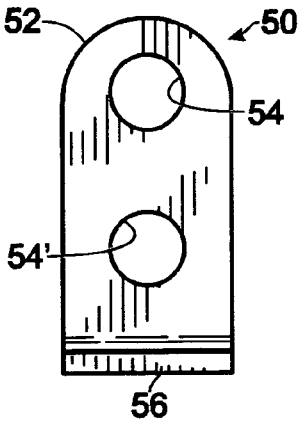
FIG. 6A is a top plan view of a first dual key padlock link requiring the use of two keys for entry.
Figure 6B:
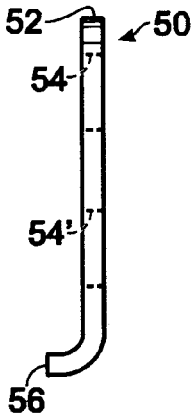
FIG. 6B is a side elevational view of the first dual key padlock link.

FIGS. 6A and 6B shows a first dual key padlock link 50 having a rounded outer end 52, padlock shackle opening 54 and security padlock opening 54' extending therethrough, and a stop member 56 extending from the inner end thereof. In use, one leg 12 or 12' of front slotted U-bolt shackle 10 is inserted through the locking opening of a latch member, or both legs 12 and 12' inserted through the ends of a locking chain. A first dual key padlock link 50 is inserted through slot 16 of U-bolt shackle 10, and a second link 30, 40 or 50 is inserted through slot 16' of U-bolt shackle 10. The shackles of first and second padlocks (not shown) are then inserted through the padlock shackle opening 54 and security padlock opening 54' of first dual key padlock link 50 and locked. Since the padlock shackle opening 54 and security padlock opening 54' are located on the same side of leg 12 or 12', the locked closure can be opened only by the keyholders of both the first and second padlocks by unlocking and removing both padlocks. This arrangement provides added security for access and could be used, for example, in locking a strong box containing cash or other valuables.

Figure 7B:
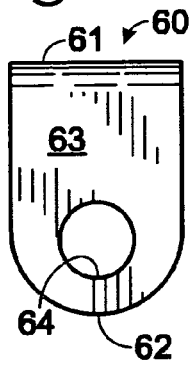
FIG. 7B is a side elevational view of the second dual key padlock link.
Figure 7A:
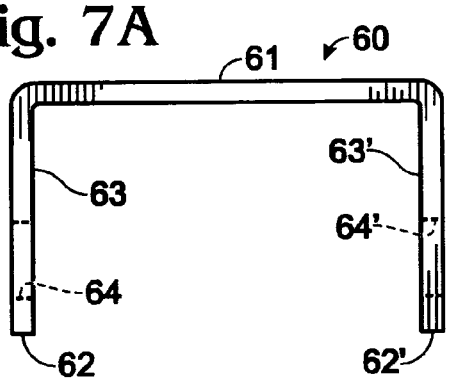
FIG. 7A is a top plan view of a second dual key padlock link requiring the use of two keys for entry.

FIGS. 7A and 7B show a second, U-shaped, dual key padlock link 60 having a base 61, and right and left arms 63 and 63' extending outwardly therefrom. The outer ends 62 and 62' of right and left arms 63 and 63', respectively, are rounded. Padlock shackle openings 64 and 64' extend through right and left arms 63 and 63', respectively. In use, right and left arms 63 and 63' of second dual key padlock link 60 are inserted through slots 16 and 16', respectively, of front slotted U-bolt shackle 10. The shackles of first and second padlocks (not shown) are inserted through the padlock shackle openings 64 and 64' in right and left arms 63 and 63' and locked. Since right and left arms 63 and 63' are joined by base 61, the locked closure can be opened only by the keyholders of both the first and second padlocks by unlocking and removing both padlocks.

Figure 8:
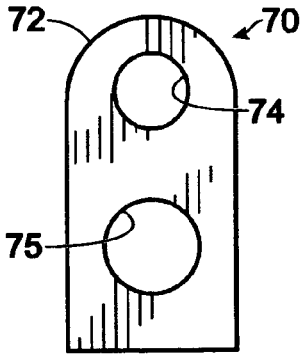
FIG. 8 is a top plan view of a one hole padlock link with an opening for attachment to a cable.

FIG. 8 shows a one hole padlock/cable link 70 having a rounded outer end 72 and a padlock shackle opening 74. Cable opening 75 allows attachment of one end of a cable or chain. The other end of the cable or chain would be attached to a second one hole padlock/cable link 70. In use, the one hole padlock/cable links 70 attached to each end of a cable or chain would be inserted through slots 16 and 16' of U-bolt shackle 10, and the shackles of first and second padlocks inserted through padlock shackle openings 74, similar to use of the one hole padlock link 30 discussed above.

Figure 9:
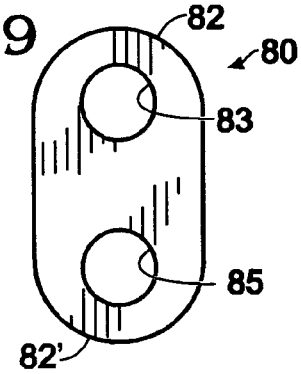
FIG. 9 is a top plan view of a U-bolt shackle used for connecting together a plurality of U-bolt shackles.
Figure 10:
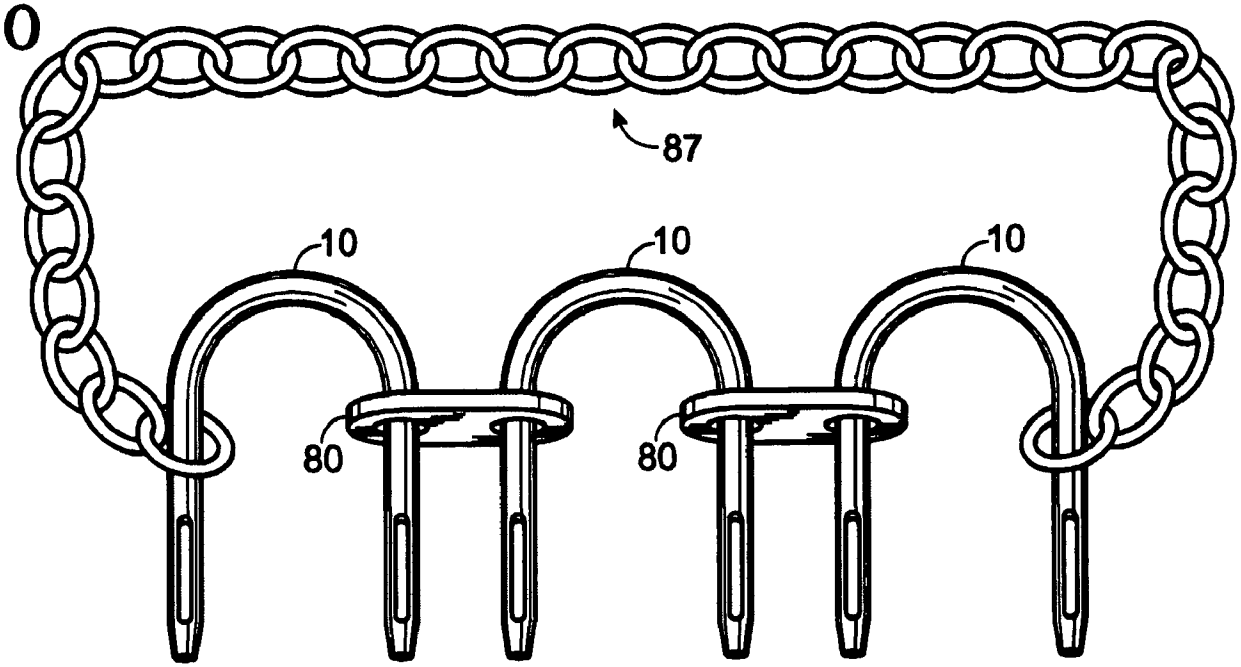
FIG. 10 is a front perspective view of three U-bolt shackles and U-bolt shackle connectors attached to a chain.

FIG. 9 shows a U-bolt shackle connector 80 having rounded ends 82 and 82'. U-bolt shackle leg openings 83 and 85 pass through U-bolt shackle connector 80. FIG. 10 shows how the legs 12 and 12' of multiple front slotted U-bolt shackles 10 are passed through U-bolt shackle leg openings 83 and 85 of U-bolt shackle connector 80, with the outer legs 12 and 12' passing through the end links of a chain 87. Any suitable link 30, 40 or 50, or any combination thereof, are passed through the slots 16 and 16' of the front slotted U-bolt shackles 10, and padlocks attached thereto. With this configuration, a large number of users can be securely accommodated. Connector 80 could also be used with side slotted U-bolt shackle 20.

Figure 11:
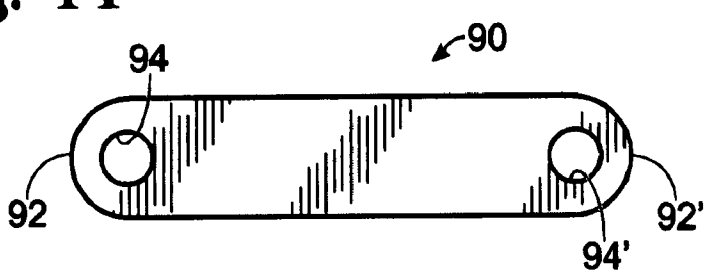
FIG. 11 is a top plan view of an access link for use with the side slotted U-bolt shackle that requires unlocking by one out of two users.

FIG. 11 shows a side slotted U-bolt shackle link 90 for use with side slotted U-bolt shackle 20. Side slotted U-bolt shackle link 90 has rounded ends 92 and 92', and padlock shackle openings 94 and 94'. In use, side slotted U-bolt shackle link 90 is inserted through side slots 26 and 26' of side slotted U-bolt shackle 20 until both padlock shackle openings 94 and 94' are outside legs 22 and 22'. The shackles of first and second padlocks (not shown) are passed through padlock shackle openings 94 and 94' and locked. The keyholder of either padlock can unlock this system.

Figure 12:
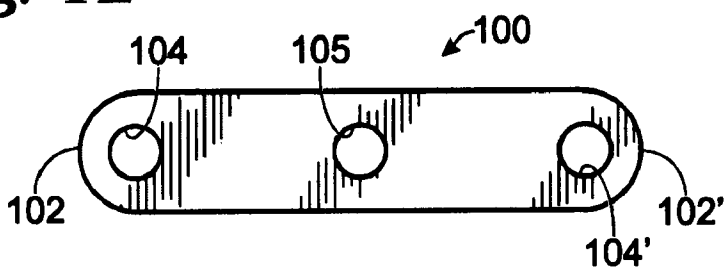
FIG. 12 is a top plan view of an access link for use with the side slotted U-bolt shackle that requires unlocking by two out of three users.

FIG. 12 shows a dual key side slotted U-bolt shackle link 100 for use with side slotted U-bolt shackle 20. Side slotted U-bolt shackle link 100 has rounded ends 102 and 102', padlock shackle openings 104 and 104', and security padlock shackle opening 105. In use, side slotted U-bolt shackle link 100 is inserted through side slots 26 and 26' of side slotted U-bolt shackle 20 until both outer padlock shackle openings 104 and 104' are outside legs 22 and 22'. Security padlock shackle opening 105 is positioned between the two legs 22 and 22'. The shackles of first and second user padlocks are passed through padlock shackle openings 104 and 104' and locked. The person to whom the duty of providing a second key to the other two users places his padlock on security padlock shackle opening 105. The keyholder of either of the padlocks attached to padlock shackle openings 104 and 104' require that the keyholder of the padlock attached to security padlock shackle opening 105 be present to unlock the system.

Although in the preceding discussion of the multiple entry locking system of the present invention reference has been made to the use of padlocks as the locking means, any keyed lock, combination lock, or other lock having a shackle may be used with the present system.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A multiple entry locking system comprising:

at least one U-bolt shackle having first and second legs joined by a cross member, each of said first and second legs having a front, a rear and sides, each of said first and second legs having a slot extending therethrough from the front to the rear thereof;

first and second link members adapted to be inserted into said slots of said first and second legs, respectively, each of said first and second link members having a first and second end, each of said first and second link members having at least one lock shackle opening passing therethrough adjacent one of said first and second ends thereof, said lock shackle opening being adapted to receive the shackle of a lock, and means adjacent the other of said first and second ends of said link members adapted to prevent withdrawal of said link members through said slots in the direction of said lock shackle openings.

2. The locking system of claim 1 wherein a link member has an opening adjacent the other of said first and second ends adapted to receive a cable or chain.

3. The locking system of claim 1 wherein said means to prevent withdrawal of at least one of said first and second link members is a stop member.

4. The locking system of claim 3 wherein at least one of said first and second said link members including a stop member has a security lock opening located adjacent and inwardly of said lock shackle opening and adapted to receive the shackle of a second, security lock.

5. The locking system of claim 1 wherein said means to prevent withdrawal of at least one of said first and second link members includes a second lock shackle opening passing through said link member adjacent the other of said first and second ends, and adapted to receive a lock through said second lock shackle opening to thereby prevent said withdrawal.

6. The locking system of claim 1 wherein each of said first and second link members includes a second lock shackle opening passing through said link members adjacent the other of said first and second ends.

7. The locking system of claim 1 wherein a single U-shaped link member is employed, said U-shaped link member having first and second link member legs joined by a cross member, the distance between said link member legs corresponding to the distance between said slots of said first and second legs of said U-bolt shackle whereby said first and second link member legs are adapted to be inserted into said slots of said first and second legs of said U-bolt shackle, each of said link member legs having a lock shackle opening passing therethrough.

8. A two lock entry locking system comprising:

a U-bolt shackle having first and second legs joined by a cross member, each of said first and second legs having a front, a rear and sides, each of said first and second legs having a slot extending therethrough from the front to the rear;

first and second link members adapted to be inserted into said slots of said first and second legs, respectively, each of said link members having a first and second end, each of said link members having one lock shackle opening passing therethrough adjacent one of said first and second ends thereof, said lock shackle opening being adapted to receive the shackle of a lock, and means adjacent the other of said first and second ends of said link members adapted to prevent withdrawal of said link members through said slots in the direction of said lock shackle openings.

9. A three lock entry locking system comprising:

a U-bolt shackle having first and second legs joined by a cross member, each of said first and second legs having a front, a rear and sides, each of said first and second legs having a slot extending therethrough from the front to the rear;

first and second link members adapted to be inserted into said slots of said first and second legs, respectively, each of said link members having a first and second end;

said first link member having at least one lock shackle opening passing therethrough adjacent one of said first and second ends thereof, said lock shackle opening being adapted to receive the shackle of a lock, and means adjacent the other of said first and second ends of said link member adapted to prevent withdrawal of said link member through said slot in the direction of said lock shackle opening;

said second link member having a lock shackle opening passing therethrough adjacent each of said first and second ends thereof, said lock shackle openings being adapted to receive the shackle of a lock.

10. A four lock entry locking system comprising:

a U-bolt shackle having first and second legs joined by a cross member, each of said first and second legs having a front, a rear and sides, each of said first and second legs having a slot extending therethrough from the front to the rear thereof;

first and second link members adapted to be inserted into said slots of said first and second legs, respectively, each of said link members having a first and second end, each of said link members having lock shackle openings passing therethrough adjacent each of said first and second ends thereof, said lock shackle openings being adapted to receive the shackle of a lock.

* * * * *